United States Patent [19]

Klenk et al.

[11] 4,215,716

[45] Aug. 5, 1980

[54] ONE-WAY CONDUIT CLOSURE

[76] Inventors: Adam Klenk; Helmut Klenk, both of Asbacherstr. 5, 6101 Modautal, Ernsthofen, Fed. Rep. of Germany

[21] Appl. No.: 868,835

[22] Filed: Jan. 12, 1978

[30] Foreign Application Priority Data

Jan. 13, 1977 [DE] Fed. Rep. of Germany ..... 2701157

[51] Int. Cl.[2] ..... F16K 15/03

[52] U.S. Cl. ..... 137/527.4; 137/527.6; 137/527.8; 137/247.19; 137/403

[58] Field of Search ..... 137/527.4, 527.6, 527.8, 137/247.19, 403

[56] References Cited

U.S. PATENT DOCUMENTS

| | | | |
|---|---|---|---|
| 162,268 | 4/1875 | Bourne | 137/527.8 X |
| 186,832 | 1/1877 | Greenwood | 137/527.8 X |
| 2,282,532 | 5/1942 | Shenk | 137/527.4 |
| 3,677,289 | 7/1972 | Rivers et al. | 137/527.4 X |
| 3,838,706 | 10/1974 | Klenk et al. | 137/527.8 X |

*Primary Examiner*—William R. Cline
*Attorney, Agent, or Firm*—Michael J. Striker

[57] ABSTRACT

A conduit has an upper and a lower open end. A sealing ring surrounds the conduit exteriorly adjacent the lower open end, and a cover is mounted on the conduit to be located beneath the lower open end. The normally upwardly facing side of the cover is provided with a depression surrounded by an upstanding rim which is normally in engagement with the sealing ring. The cover is mounted for swinging movement, about a mounting shaft defining a swinging axis, from this normally closed position downwards to an open position. A counterweight normally holds the cover in the closed position, but when the liquid in the depression reaches a predetermined amount, the weight of the liquid triggers a quick opening of the cover, discharge of accumulated liquid, followed by quick closing of the cover. The cover is so mounted that the end thereof near the mounting shaft can move vertically relative to the mounting shaft. Furthermore the biasing force derived from the counterweight is physically applied to the cover at a location approximately midway between the end of the cover nearest and that most remote from the mounting shaft. As a result of these latter two factors, when the cover swings upward to closed position, it can freely position itself in such a way that the entirety of its upstanding rim seal-tightly engages the sealing ring.

9 Claims, 4 Drawing Figures

ONE-WAY CONDUIT CLOSURE

BACKGROUND OF THE INVENTION

The present invention relates to a construction similar to that disclosed in our earlier U.S. Pat. No. 3,838,706, the entire disclosure of which is incorporated herein by reference.

The construction disclosed in that patent is a conduit closure, especially for use to prevent both backflow and also the escape of noxious gases. The closure includes a downwardly extending internal conduit and a swingable cover, mounted for swinging movement on a horizontal shaft located to the side of the internal conduit. A counterweight connected to the cover by lever arms normally urges the cover upward into its closed position. When in its closed position, the upper rectangular rim of the cover seal-tightly engages a sealing ring. The sealing ring is located exteriorly of the internal conduit, at an elevation higher than the bottom end of the internal conduit. The cover is generally shovel-shaped and has an inclined bottom wall which, when the cover is closed, slopes upward in the direction away from the aforementioned shaft and terminates at a spillover edge. The cover collects incoming fluid, and when a certain amount of fluid has been collected spontaneously and quickly swings down into its open position. The amount of fluid which triggers this quick downswing is such that, when this amount of fluid is collected, the upper level of the body of fluid is located beneath the bottom end of the aforementioned internal conduit. When the cover is in its upwardly swung, closed position, it, the mounting shaft, and the counterweight are all located at about the same height. The disposition of the latter three parts is such that, when the quantity of water in question has been accumulated, the biasing force of the counterweight is overcome; as the counterweight begins to swing upward, the biasing force it exerts (such as to tend to close the cover) decreases, the furthermore, the collected water displaces itself towards the spillover edge of the cover thereby exerting a greater opening force, so that the opening movement of the cover is very quick and positive.

This construction has a number of advantages. The cover opens, only briefly, to discharge collected fluid when the predetermined quantity of fluid has accumulated. When in the open position, the cover is located out of the way of the descending fluid. Furthermore, after such discharge, if a sizable flow of fluid is not entering the closure, the cover closes again completely, without dwelling in intermediate positions. Accordingly, the cover is normally closed, when it opens does so only briefly to discharge an accumulated amount of water, and when it is thusly open for short periods presents little opportunity for the escape of noxious or polluting gases. Furthermore, relatively large solid bodies such as stones or clumps of leaves easily pass through the closure when the cover is in open position. Accordingly, there is no danger that such solid bodies will become lodged between the cover and its cooperating sealing ring, which could result in the continual escape of gases through the conduit closure. Furthermore, because the accumulated fluid cannot rise to the level of the sealing ring, the latter is protected from being frozen solid onto the cover in winter conditions.

However, it has been found that despite the above-enumerated advantages inherent in this construction, with long use the reliability of the sealing action which prevents the escape of gases becomes less certain and positive. In particular, it has been found that loss of seal-tightness can develop at those portions of the upper rim of the cover which are adjacent to the shaft on which the cover is swingably mounted. This is because, at these locations, the sealing force with which the rim of the cover presses against the sealing ring is not sufficient to assure that, as the mountings of the cover wear and the sealing ring looses some of its elasticity, the sealing action will nevertheless continue to be positive and complete. The counterweight which biases the cover to its closed position does not help in this respect. The upwards force transmitted to the cover by the counterweight is mainly applied, for various reasons, to the part of the cover remote from the mounting shaft. Certainly, upwards force is also transmitted, by lever action, to the part of the cover close to the mounting shaft. However, at this location, i.e., near where the cover and counterweight are supported for swinging movement, the weight of the cover and counterweight pulls down. As a result, if there is any play whatsoever in the mountings of the cover and counterweight, this downwards force can pull this part of the cover away from its cooperating part of the sealing ring. Accordingly, in the region near the mounting shaft, there sets in a loss in the elastic compressibility of the sealing ring and an actual increase of the play with which the cover and counterweight are swingably mounted.

SUMMARY OF THE INVENTION

It is a general object of the invention to provide a closure of the general type in question, but of such a design that its service life before loss of seal tightness occurs is much longer, and such that when loss of seal tightness is incipient the situation can be corrected without replacement of any component elements.

According to one concept of the invention, this is achieved by providing the cover and the counterweight as separate parts and separately mounting them for swinging movement, with the biasing force applied by the counterweight to the cover being applied to a portion thereof located midway between the end of the cover nearest and that most remote from the shaft on which the cover is pivotally mounted. Furthermore, the cover is pivotally mounted on its mounting shaft with vertical displaceability at its mounting point. As a result, when the cover is brought to its closed position, the closing force applied to a middle portion of the cover assures that the upper rim of the cover seal-tightly engages the sealing ring at every point on the upper rim, and this action is not interfered with by anything occurring near the mounting points of the cover.

Actually, it is known from German Pat. No. 322 435 that the closing force generated by a counterweight can be applied to a middle portion of flap member, to improve the uniformity of the engagement between the flap member and all portions of its seat. However, in that patent, what is involved is a simple flap intended to prevent backflow, not provided with a cooperating sealing ring to prevent the escape of noxious or polluting gases. In that case, when the closing action is most important, i.e., when a backflow situation is about to occur, the backflow force itself tends to close the backflow-prevention flap, adding to the force applied by the counterweight, and in that sense anyway providing a more uniform closing force upon the flap, so that the action and advantages of the present invention are not actually to be found. This is particularly so, because the vertical shiftability at the mounting points for the closure cover, provided in the present invention, is not provided in that construction; accordingly, in that construction, the closing force generated by the counterweight is partly applied to closure flap per se and partly loaded onto the mounting shaft of the flap, so that the flap cannot freely find its own best position and by itself best establish a uniform closure all around its locus of engagement with its seat.

With the construction of the present invention, the closure cover is not pressed against the cooperating sealing ring from the side of the closure cover, but instead the rim of the cover presses uniformly upon all portions of the sealing ring, without the weight of the counterweight itself tending to pull the part of the cover nearest its mounting shaft away from the cooperating part of the sealing ring. Because the mountings of the closure cover include provision for vertical shiftability, the part of the cover nearest the mounting shaft can be pressed against the sealing ring, without the physical presence of the mounting shaft blocking, resisting or otherwise interfering with the pressing force involved. As a result, the cover, when moved to closing position, tends to find by itself its own best and most complete seating against the sealing ring, even if the properties of different parts of the sealing ring change with age. Because of this fact, the dimensional variations permissible in manufacturing the component elements of the inventive closure, and the precision with which the relative positions of the component parts must be established during assembly, become less critical. In particular, changes in the dimensions of components, of parts of components, of relative positions at mounting and sealing points, and so forth, occurring during use and aging, tend to be compensated out inherently with the inventive construction. Thus, the reliability of the seal preventing escape of gases does not decrease with prolonged use of the closure.

The exact extent of the vertical displaceability to be provided for the cover relative to its pivotal mounting point depends upon the specifics of the particular application contemplated, including the materials employed for the component parts and in particular the type of sealing ring employed. The amount of vertical displaceability to be established should be such as to take into account all dimensional changes which are to be expected due to wear and aging, and in particular the wearing away of the sealing ring. For example, as will become clearer from the detailed description below, when the inventive closure is new and newly installed, it can be set up such that the possibility of vertical displacement built into the mounting points for the cover is not actually utilized; i.e., pure pivot action is involved only, and is enough to ensure that the portion of the cover nearest the swinging axis of the cover presses against the cooperating part of the sealing ring with sufficient force. One then estimates how much this part of the sealing ring, and this part of the rim of the cover, will wear during use and aging, and from that one estimates how much higher this part of the rim of the cover must be raised after such wear and aging has actually occurred. The amount of the vertical displaceability to be built in, in such case, must then be such that the part of the cover in question can be raised to the greater elevation required after such wear and aging has occurred. For typical practical applications, such as use in a drainage system, the requisite amount of vertical displaceability determined in the manner just explained will in general be on the order of several millimeters. For example, when the cover is in its closed position when the conduit closure is new and newly installed and the vertical displaceability is not yet utilized, it will be possible to push the part of the cover nearest its mounting shaft an upward distance of e.g., 5 to 15 mm, i.e., upwardly beyond the position which this part of the cover has assumed by itself. However, this exemplary range is to be understood not to be absolute, because it will of course depend upon such factors as the overall dimensions of the structure.

In the preferred embodiment of the invention, the closure cover is provided with two axially spaced mounting portions, each having a generally oval mounting opening receiving a respective end portion of the non-rotatable mounting shaft for the cover, and the lever arms which carry the counterweight are also mounted on this shaft. In this way, despite the vertical displaceability relative to the mounting shaft, the cover is supported by its mounting shaft positively and with definiteness.

In the preferred embodiment, the lever arms which support the counterweight engage the cover, and transmit force thereto, at two pegs, each provided at the middle of a respective side wall of the cover and projecting outwardly of such respective side wall. This expedient makes for a particularly stable construction, which is quite easy to assemble and operates very simply and reliably.

As already explained, when the cover is moved to closed position, if the entire upper rim of the cover does not equally seat upon all portions of the sealing ring, and instead sealingly engages only part of the sealing ring, e.g., along the rim edge most remote from the cover swinging axis, then because of the vertical displaceability, the cover can perform an auxiliary swinging movement, about an axis parallel to its mounting shaft, such as to bring all portions of the rim of the cover into sealing engagement with the sealing ring. According to another concept of the invention, the possibility of a still further corrective swinging movement is introduced, namely about a swinging axis located where the rim of the cover first contacts the sealing ring during closing and extending perpendicular to the mounting shaft of the cover. In the preferred embodiment, this is implemented by providing each of the aforementioned lever arms with a separate counterweight of its own, and by making the two lever arms swingable independently of each other. In this way, in order that the cover itself find its own best position upon the sealing ring, the two separate lever arms and counterweights can assume different elevations, such that the side of the cover associated with each such arm rises to a height where it will properly engage its respective part of the sealing ring. With this expedient, the cover has virtually unlimited freedom in finding its own best position against the sealing ring. This further degree of tilting freedom could, alternatively, be implemented by mounting the counter weight on each of the two lever arms with play, i.e., so that the counterweight would not in itself tend to couple the two lever arms together for identical movement, but instead permit the two lever arms to rise to different heights, in order that the cover finds its own best position.

According to a further concept of the invention, the height or elevation of the mounting shaft is adjustable.

This makes it possible to so adjust the mounting shaft that the cover, when it closes, does not lift or lift appreciably relative to the mounting shaft, i.e., performs a pure pivotal movement and does not need to actually utilize the vertical displaceability which has been built in. For example, the mounting shaft could be thusly adjusted when the conduit closure is new and newly installed, and then again after a period of wear and aging has passed.

The height-adjustability of the mounting shaft can be readily achieved by locating the ends of the shaft in two mounting elements having vertically elongated holding openings, with the mounting elements having at their bottoms threaded openings which receive threaded height-adjusting screws.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
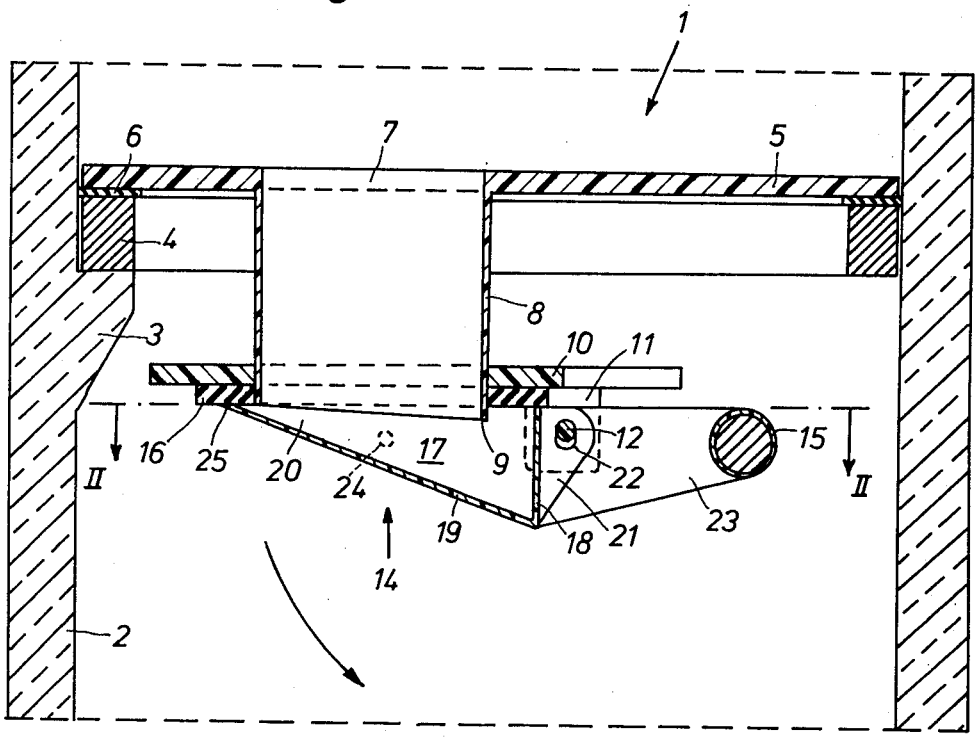
FIG. 1 is a vertical section through an exemplary conduit closure embodying the present invention.

In FIG. 1, numeral 1 generally denotes the conduit closure per se. Here, the conduit closure serves to prevent backflow and to prevent the escape of noxious and polluting gases. The conduit closure 1 is built into an upright shaft 2 of circular cross section, for example an entrance shaft into a reservoir, a drainage conduit, or the like. The inner circumference of the shaft 2 is provided with three abutments (there could be fewer or more) which are spaced in circumferential direction and designated with reference numeral 3, and which support a ring 4 which in turn supports the closure 1.

The closure 1 comprises a mounting element 5 of circular cross section, whose diameter corresponds to the internal diameter of the shaft 2 and which is provided at its underside with a circumferentially extending sealing ring 6 engaging the ring 4 and providing a seal therewith. An off-center rectangular inlet opening 7 is provided in the plate 5 and communicates with an upright conduit 8 which is fixedly connected with the plate or mounting element 5 and of the same cross section as the opening 7. The conduit 8 extends downwardly from the plate 5 and has, as illustrated in the drawing, an upper open end and a lower open end. The lower open end of the conduit 8 is designated with reference numeral 9 and above it a plate 10 is fixedly connected with the conduit 8 to extend in parallelism with the plate 5. Its cross section does not completely fill the cross section of the shaft 2. The underside of the plate 10 is provided with two mounting elements 11 which are spaced from one another and between which a shaft 12 extends in horizontal direction.

The shaft 12 pivotally carries a cover 14, which is biased to the closed position shown in FIG. 1 by means of a counterweight 15. When the cover 14 is in this closed position, its upper planar and rectangular rim, constituted by the upper edges of its constituent walls, presses seal-tightly against a sealing ring 16. Sealing ring 16 is located outwardly of the conduit 8 and is secured to the bottom side of the plate 10. The lower end 9 of the conduit 8 extends downwardly past the sealing ring 16.

The cover 14 will be seen to be generally shovel-shaped in its configuration, having a side which normally faces upwardly and which is provided with a depression in which liquid entering through the upper open end of the conduit 8 can accumulate. The depression 17 is defined by a wall 18 adjacent the shaft 12, a surface 19 which extends from the lower edge of the wall 18, and two triangular side walls 20. As can be seen, the bottom wall 19 is so inclined, in the closed position of cover 14, as to slope upwardly from the bottom edge of wall 18 and terminate at an overflow edge 25 remote from the shaft 12.

The two side walls 20 extend rightwards past the end wall 18, forming two axially spaced mounting projections 21. Each mounting projection 21 has a generally oval mounting opening 22 which receives a respective end portion of the shaft 12. As shown in FIG. 1, when the cover 14 is in its closed position, the largest dimension of each oval mounting opening 22 is its vertical dimension. Accordingly, when closed, the cover 14 is mounted on shaft 12 with a corresponding amount of vertical displaceability.

The counterweight 15 is mounted between two arms 23. Each arm 23, approximately midway between its left and right ends, is swingably mounted on the shaft 12. Each arm 23 extends along the exterior of a respective one of the two side walls 20, as seen most clearly in FIG. 2, spaced a small distance therefrom. Each side wall 20 is provided with a respective peg 24, e.g., integral therewith. The pegs 24 project outwardly from the respective side wall 20, and extend parallel to the shaft 12. Each arm 23 is provided with an opening which is pushed onto a respective one of the pegs 24. In this embodiment, the arms 23, leftward of end wall 18, have the same triangular shape as do the side walls 20, leftward of end wall 18. However, it is not imperative that the vertical dimension of the arms 23 (as viewed in FIG. 1) correspond to the vertical dimension of the adjoining portions of the side walls 20; likewise, it is not imperative that the arms 23 extend so far leftward past the mounting pegs 24.

As shown in FIG. 1, when the cover 14 is closed, the cover 14, the shaft 12 and the counterweight 15 are generally disposed in a common horizontal plane. In this embodiment, the cover 14 and the counterweight 15 can swing from the illustrated closed position, through an angle of about 90°, to a completely open position, in the direction indicated by the arrow in FIG. 1.

Figure 2:
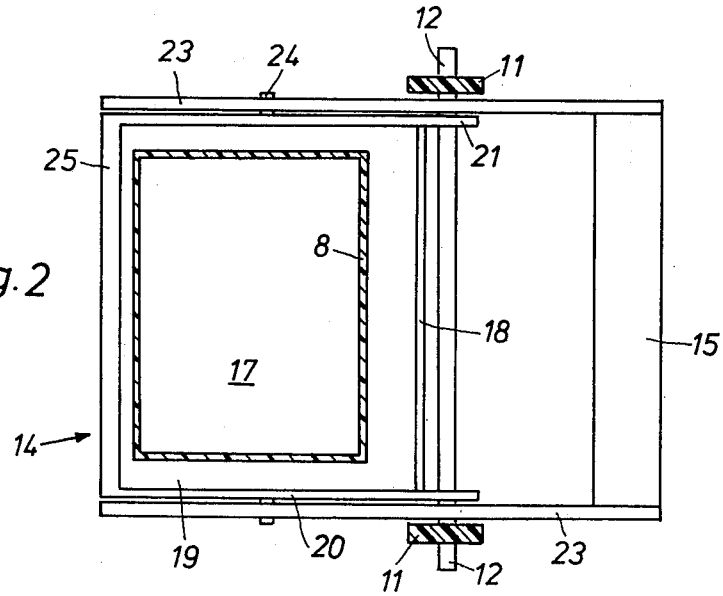
FIG. 2 is a section through part of the structure of FIG. 1, taken on line II—II.
Figure 3:
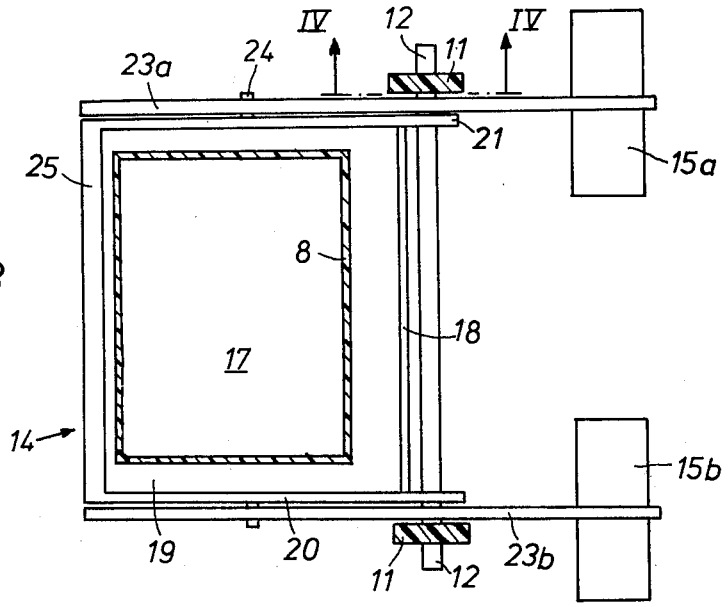
FIG. 3 is a view similar to FIG. 2, but of a modified construction.

FIG. 3 is a view like FIG. 2, showing a modified construction. Here, use is made of two distinct counterweights 15*a* and 15*b*, each mounted on a respective one of two arms 23*a*, and 23*b*. Accordingly, in this embodiment, the two arms 23*a*, 23*b* are individually biased to the closed position of FIG. 1. With this construction, when the cover 14 is caused to assume the closed position shown in FIG. 1, the upper edges of the two side walls 20 may be brought to somewhat differing heights, i.e., to such heights that each one seal-tightly presses against the associated portion of the sealing ring 16.

Figure 4:
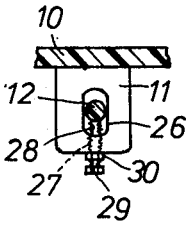
FIG. 4 depicts the vertical adjustability of the pivot shaft for the cover of the conduit closure.

FIG. 4 depicts a construction in which the shaft 12 can be adjusted with respect to elevation, relative to the two mounting elements 11 already described with respect to FIGS. 1 and 2. To this end, each mounting element 11 has a mounting opening 26 which is elongated in the vertical direction. The two end portions of shaft 12 are received in respective ones of these elongated mounting openings 26. The part of each mounting element 11 located beneath its opening 26 has a vertically extending threaded bore 27, into which is screwed a respective threaded height-adjustment screw 28. The height-adjustment screws 28 are provided with heads 29, and after adjusted to set a proper height are locked in place by means of respective lock nuts 30. As illustrated, the upper end of each height-adjustment screw 28 is received within a respective threaded blind bore at the bottom side of the shaft 12. In this way, the shaft 12 can be adjusted with respect to height relative to the mounting openings 26 in the mounting elements 11, and furthermore be held, without play, at the adjusted height. The height-adjustment for the two ends of the shaft 12 is performed in such a way that the positions depicted in FIG. 1 are achieved. In particular, when the cover 14 is moved to its closed position, and the rectangular upper rim of cover 14 presses against the sealing ring 16, the engagement between such upper rim and sealing ring 16 should be complete all around the rim, and this engagement should be achieved without the cover 14, as a whole, having first to perform a rising movement relative to the shaft 12; i.e., the final part of the closing movement of the cover 14 should involve only swinging movement of the cover 14 on the shaft 12, and the cover 14 is not, during such final movement, to be permitted to rise as a whole in such a way that the shaft 12 would no longer be located at the upper ends of the oval mounting openings 22 of the projections 22 of the side walls 20.

It will be understood that each of the elements described above, or two or more together, may also find a useful application in other types of constructions differing from the types described above.

While the invention has been illustrated and described as embodied in a particular type of conduit closure, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A closure in a conduit having an opening bounded by an annular seat, said closure comprising a cover for closing the opening of the conduit and having an annular seal engageable with the seat; means mounting said cover for swinging movement about a generally horizontal axis between a first position in which the opening is open and a second position in which said cover closes the opening, said mounting means including a mounting shaft defining said generally horizontal axis; cooperating means on said cover and said mounting means for permitting limited tilting movement of said cover on said mounting means and relative to said generally horizontal axis to thereby ensure that all portions of said seal of said cover seal-tightly engage all portions of said annular seat circumferentially of said opening; means for selectively varying the vertical height of said mounting shaft relative to said annular seat to thereby compensate for the changes in the annular seat and said annular seal during use and aging thereof; and means for normally swinging said cover into said second position, and including a counterweight and a lever structure mounted for pivotal movement about said generally horizontal axis, said counterweight being supported by the lever structure and said cover being mounted on said lever structure, said cover including two side walls spaced from each other in the direction of elongation of said axis and each provided with an outwardly extending projection midway between the end thereof closest to said axis and the end thereof remote from said axis, said lever structure comprising two levers, each swingable about said axis, each supporting to one side the counterweight, and each coupled at the other side to a respective one of the outwardly extending projections on the side walls of the cover.

2. A one-way closure for discharge conduits operative for preventing the escape of gases, comprising, in combination, a mounting element connected to the discharge conduit interiorly thereof and subdividing the same into an upper and a lower compartment; an elongated connecting conduit sealingly connected to the mounting element and having an upper end portion communicating with the upper compartment, a lower end portion communicating with the lower compartment, and an internal surface bounding a liquid-flow path between the upper and lower compartments; a sealing ring arranged exteriorly of and above the lower end portion of the elongated connecting conduit; a cover having an upper side with a rim and two mounting portions; means mounting the cover for swinging movement about a generally horizontal first axis between a generally horizontal closed position in which the rim of the cover seal tightly engages the sealing ring and a downwardly swung open position, said mounting means including a mounting shaft defining said first axis of the cover; adjusting means mounting the cover at the end thereof nearest said generally horizontal first axis for limited vertical displacement of said end and relative to said generally horizontal first axis, said adjusting means including a mounting opening generally oval in shape provided on each mounting portion of the cover and operative for receiving the mounting shaft; and biasing means operative for normally moving the cover to said closed position, including a counterweight and a lever structure mounted about a generally horizontal second axis, the counterweight being supported by the lever structure and said cover being mounted on said lever structure for limited movement relative thereto about said first axis within the limits permitted by said adjusting means, said counterweight causing the cover to move to said closed position so that said rim of the cover seal-tightly engages the sealing ring.

3. A one-way closure for discharge conduits operative for preventing the escape of gases comprising, in combination, a mounting element connected to the discharge conduit interiorly thereof and subdividing the same into an upper and a lower compartment; an elongated connecting conduit sealingly connected to the mounting element and having an upper end portion communicating with the upper compartment, a lower end portion communicating with the lower compartment, and an internal surface bounding a liquid-flow path between the upper and lower compartments; a sealing ring arranged exteriorly of and above the lower end portion of the elongated connecting conduit; a cover having an upper side with a rim; means mounting the cover for swinging movement about a generally horizontal first axis between a generally horizontal closed position in which the rim of the cover seal-tightly engages the sealing ring and a downwardly swung open position; adjusting means mounting the cover at the end thereof nearest said generally horizontal first axis for limited vertical displacement of said end relative to said generally horizontal first axis; and biasing means operative for normally moving the cover to said closed position, and including two counterweights and a lever structure comprising two levers, mounted for pivotal movement about a generally horizontal second axis, each lever being swingable about said generally horizontal second axis and supporting to one side a respective counterweight, and each lever being coupled at the other side to a portion of the cover midway between ends of the cover for limited tilting movement relative to the lever structure about said first axis within the limits permited by said adjusting means, so that when said counterweights urge said cover to said closed position the two levers can permit the two counterweights to assume different elevations and thereby increase the freedom with which the cover can tilt to find a position in which the entirety of said rim seal-tightly engages the sealing ring.

4. A one-way closure for discharge conduits operative for preventing the escape of gases comprising, in combination, a mounting element connected to the discharge conduit interiorly thereof and subdividing the same into an upper and a lower compartment; an elongated connecting conduit sealingly connected to the mounting element and having an upper end portion communicating with the upper compartment, a lower end portion communicating with the lower compartment, and an internal surface bounding a liquid-flow path between the upper and lower compartments; a sealing ring arranged exteriorly of and above the lower end portion of the elongated connecting conduit; a cover having an upper side with a rim; means mounting the cover for swinging movement about a generally horizontal first axis between a generally horizontal closed position in which the rim of the cover seal-tightly engages the sealing ring and a downwardly swung open position, said mounting means including a mounting shaft defining said first axis; adjusting means mounting the cover at the end thereof nearest said generally horizontal first axis for limited vertical displacement of said end relative to said generally horizontal first axis and including means for changing the vertical height of said generally horizontal first axis, said changing means comprising a holding structure including two holding members each having a holding opening receiving a respective end portion of the mounting shaft, the bottom part of each holding member below the holding opening thereof including a threaded vertically extending bore opening into the respective holding opening, each holding bore accommodating a threaded height-adjusting screw which extends upwardly into the respective holding opening and engages the mounting shaft; and biasing means operative for normally moving the cover to said closed position, including a counterweight and a lever structure mounted for pivotal movement about a generally horizontal second axis, the counterweight being supported by the lever structure and said cover being mounted on said lever structure for limited tilting movement relative thereto about said first axis within the limits permitted by said adjusting means, said counterweight causing the cover to move to said closed position so that said rim of the cover seal-tightly engages the sealing ring.

5. A one-way closure for discharge conduits operative for preventing the escape of gases comprising, in combination, a mounting element connected to the discharge conduit interiorly thereof and subdividing the same into an upper and a lower compartment; an elongated connecting conduit sealingly connected to the mounting element and having an upper end portion communicating with the upper compartment, a lower end portion communicating with the lower compartment, and an internal surface bounding a liquid-flow path between the upper and lower compartments; a sealing ring arranged exteriorly of and above the lower end portion of the elongated connecting conduit; a cover having an upper side with a rim and two spaced ends; means mounting the cover for swinging movement about a generally horizontal first axis between a generally horizontal closed position in which the rim of the cover seal-tightly engages the sealing ring and a downwardly swung open position, said mounting means including a mounting shaft defining said first axis; and means for normally swinging said cover into said closed position and including a counterweight with a lever, said cover being coupled midway between the end thereof with said lever of said counterweight for limited tilting movement relative thereto and said counterweight being also mounted on said mounting shaft for swinging movement also about said generally horizontal first axis, so that when said counterweight swings about said first axis it swings said cover about the same first axis with the limited tilting movement of said cover and thereby said rim of said cover seal-tightly engages said sealing ring.

6. The closure defined in claim 5, the means mounting the cover comprising means mounting the end of the cover nearest said generally horizontal axis of the cover for vertical displacement relative to said axis to an extent on the order of several millimeters.

7. A closure as defined in claim 5, wherein; and further comprising means for selectively varying the vertical height of said mounting shaft relative to said annular seat to thereby compensate for the changes in the annular seat and said annular seal during use and aging thereof.

8. A closure as defined in claim 5, wherein said said counterweight has a lever structure mounted for swinging movement about said generally horizontal axis.

9. A closure as defined in claim 8, wherein said counterweight is supported by the lever structure and said cover being mounted on said lever structure.

* * * * *